US006431134B1

(12) United States Patent
Hass

(10) Patent No.: US 6,431,134 B1
(45) Date of Patent: Aug. 13, 2002

(54) CAMSHAFT FOLLOWER ARRANGEMENT AND METHOD

(75) Inventor: Ruediger Hass, Kiel (DE)

(73) Assignee: Caterpillar Motoren GmbH & Co. KG (DE)

( * ) Notice: Subject to any disclaimer, the term of this patent is extended or adjusted under 35 U.S.C. 154(b) by 0 days.

(21) Appl. No.: 09/839,773

(22) Filed: Apr. 20, 2001

(51) Int. Cl.[7] ..... F01L 1/18

(52) U.S. Cl. ..... 123/90.39; 123/90.33; 123/90.48; 123/90.61; 123/90.63

(58) Field of Search ..... 123/90.33, 90.35, 123/90.36, 90.37, 90.39, 90.42, 90.48, 90.5, 90.61, 90.63, 196 M; 184/6.5, 6.9

(56) References Cited

U.S. PATENT DOCUMENTS 4,644,914 A * 2/1987 Morita ..... 123/90.55

FOREIGN PATENT DOCUMENTS

JP 405149119 A * 6/1993 ..... 123/90.33

* cited by examiner

*Primary Examiner*—Thomas Denion
*Assistant Examiner*—Jaime Corrigan
(74) *Attorney, Agent, or Firm*—Alan J. Hickman

(57) ABSTRACT

A plurality of modular camshaft follower assemblies of substantially identical construction and configuration are positively connected to a camshaft supporting structure of an internal combustion engine and adjustable to position a plurality of camshaft following lever arms at a proper timing location relative to a camshaft. Conduits in sealed serial communication with shafts pivotally supporting the camshaft following lever arms of the modular camshaft following assemblies deliver fluid flow from an engine block of the internal combustion engine to the camshaft following lever arms. The plurality of modular camshaft follower assemblies are each mounted on the engine through access openings in a side wall of the engine block.

24 Claims, 4 Drawing Sheets

CAMSHAFT FOLLOWER ARRANGEMENT AND METHOD

TECHNICAL FIELD

This invention relates generally to a camshaft follower arrangement having a modular camshaft follower assembly and more particularly to a camshaft follower arrangement and method for an internal combustion engine having a plurality of adjustable camshaft follower assemblies connected in fluid communication.

BACKGROUND

Camshaft followers are often used in internal combustion engines to provide an interface in the translation of rotary motion of a camshaft to linear motion of push rods associated with intake valves, exhaust valves and fuel injector pump. The push rods are frequently located between rocker arms associated with the intake and the exhaust valves and the camshaft followers and transfer motive force from the camshaft to open and close the intake and exhaust valves in accordance with the desired engine timing events. Push rods may also be located between a camshaft follower and a fuel injector pump and provide motive force for fuel injector pump actuation.

Typically, the camshaft followers are pivotally connected to the engine at a location in reasonable close proximity to the camshaft either individually or as an assembly. The position of the camshaft follower relative to the camshaft is critical and any deviation from nominal will effect various engine timing. It is important that engine timing events such as intake and exhaust valve opening and closing and fuel injector pump actuation occurs at a predetermined time and duration to achieve optimum operating conditions. Due to manufacturing tolerances, it is impossible to consistently achieve nominal camshaft follower positioning relative to the camshaft and accurately control timing events. In order to accommodate these deviations in the position of the camshaft follower from the nominal, adjustment of the camshaft follower relative to the camshaft is often required. Adjustments of individual or multiple camshaft followers using eccentric means, set screws and the like tend to be difficult to make. Such devices are also subject to inadvertent loosening during engine operation resulting in a deviation in the timing events from the desired and resulting in rough engine operation.

Lubrication of camshaft followers to reduce the friction at bearing interfaces with associated components and the lubrication of other components associated with engine valve actuation and fuel injector pump operation is required. Often a complex arrangement of tubing, nozzles and fittings are required in order to deliver a lubricating fluid to the appropriate locations. Such an arrangement is difficult to install on the engine, complicates assembly and disassembly of other components and is prone to leaking. It is therefore desirous to provide a sealed lubrication arrangement that is simple to manufacture and install on the engine.

It is known to provide camshaft follower assemblies for installation on internal combustion engines. Such assemblies are tailored to fit a specific location on an engine requiring that each engine has a plurality of differently configured assemblies. This requires that a plurality of different configured camshaft follower assemblies be inventoried and tracked. Further, each of such assemblies must be installed at a proper different location on the engine leading to some confusion and potential assembling problems.

The present invention is directed at overcoming one or more of the problems as set forth above.

SUMMARY OF THE INVENTION

In one aspect of the present invention a camshaft follower arrangement for an internal combustion engine having a camshaft is provided. The camshaft follower arrangement includes a modular camshaft follower assembly having a body having a first and second ends, a longitudinal bore extending between said first and second ends and a side mounting surface located between the first and second ends. The modular camshaft follower assembly has a shaft disposed in the longitudinal bore of the body and a plurality of camshaft following lever arms each having first and second spaced end portions. The camshaft following lever arms are connected at the first end portion to the shaft and pivotally movable relative to an axis of the shaft. The camshaft following lever arms are maintained at predetermined axially spaced apart locations along the shaft and extending radially from the shaft. The camshaft following lever arms are each actuatable at said second end portion by the camshaft. The camshaft follower arrangement includes a camshaft supporting structure and a shim pack having at least one shim and disposed between the side mounting surface and the camshaft supporting structure. The shim pack adjustably positions each of the camshaft following lever arms transversely relative to the camshaft and a plurality of fasteners connect the body to the camshaft supporting structure at a predetermined location relative to the camshaft.

In another aspect of the present invention a camshaft follower arrangement for an internal combustion engine having a camshaft and a plurality of substantially identical modular camshaft follower assemblies is provided. The camshaft follower arrangement has a plurality of bodies each having a first and second ends, a longitudinal bore extending between the first and second ends, and a side mounting surface located between the first and second ends. A plurality of shafts each having first and second ends and are disposed in the longitudinal bore of a respective body. The shafts each have an axially extending aperture opening at the first and second ends. A plurality of camshaft following lever arms having first and second spaced end portions are pivotally connected at the first end portion to a respective shaft. The camshaft following lever arms are maintained at predetermined axially spaced apart locations along the respective shaft. A camshaft supporting structure rotatively supports the camshaft. A first fluid passing conduit fluidly connects the first end of a first shaft of the plurality of shafts to the second end of a second shaft of the plurality of shafts and passes lubricating fluid flow between the axially extending apertures of the first and second shafts. A plurality of fasteners connects the plurality of bodies to the camshaft supporting structure and maintains the fluid passing conduit in connection with the first end of the first shaft and the second end of the second shaft.

In yet another aspect of the present invention a method of adjustably connecting each of a plurality of substantially identical modular camshaft follower assemblies to a camshaft supporting structure of an internal combustion engine is provided. The modular camshaft follower assemblies each have a body, a shaft having first and second ends and an axially extending aperture opening at the first and second ends of said shaft. The shafts are each connected to a respective body. Each of said camshaft follower module assemblies have a plurality of spaced apart camshaft following lever arms pivotally connected to the shaft at axially spaced apart locations on the shaft. The method comprises the steps of:

placing a first shim pack having at least one shim and a predetermined thickness between a side mounting surface of a body of a first modular camshaft follower assembly and a camshaft supporting structure; connecting the first modular camshaft follower assembly of said plurality to the camshaft supporting structure;

positioning a first fluid passing conduit in fluid passing communication with the axially extending aperture at the first end of the shaft of the first modular camshaft follower assembly;

positioning said first fluid passing conduit in fluid passing communication with an axially extending aperture opening at the second end of a shaft of a second modular camshaft follower assembly of the plurality of camshaft follower module assemblies;

placing a second shim pack having at least one shim and a predetermined thickness between a side mounting surface of the body of the second modular camshaft follower assembly and the camshaft supporting structure; and connecting the second modular camshaft follower assembly to the camshaft supporting structure.

DETAILED DESCRIPTION

Figure 1:
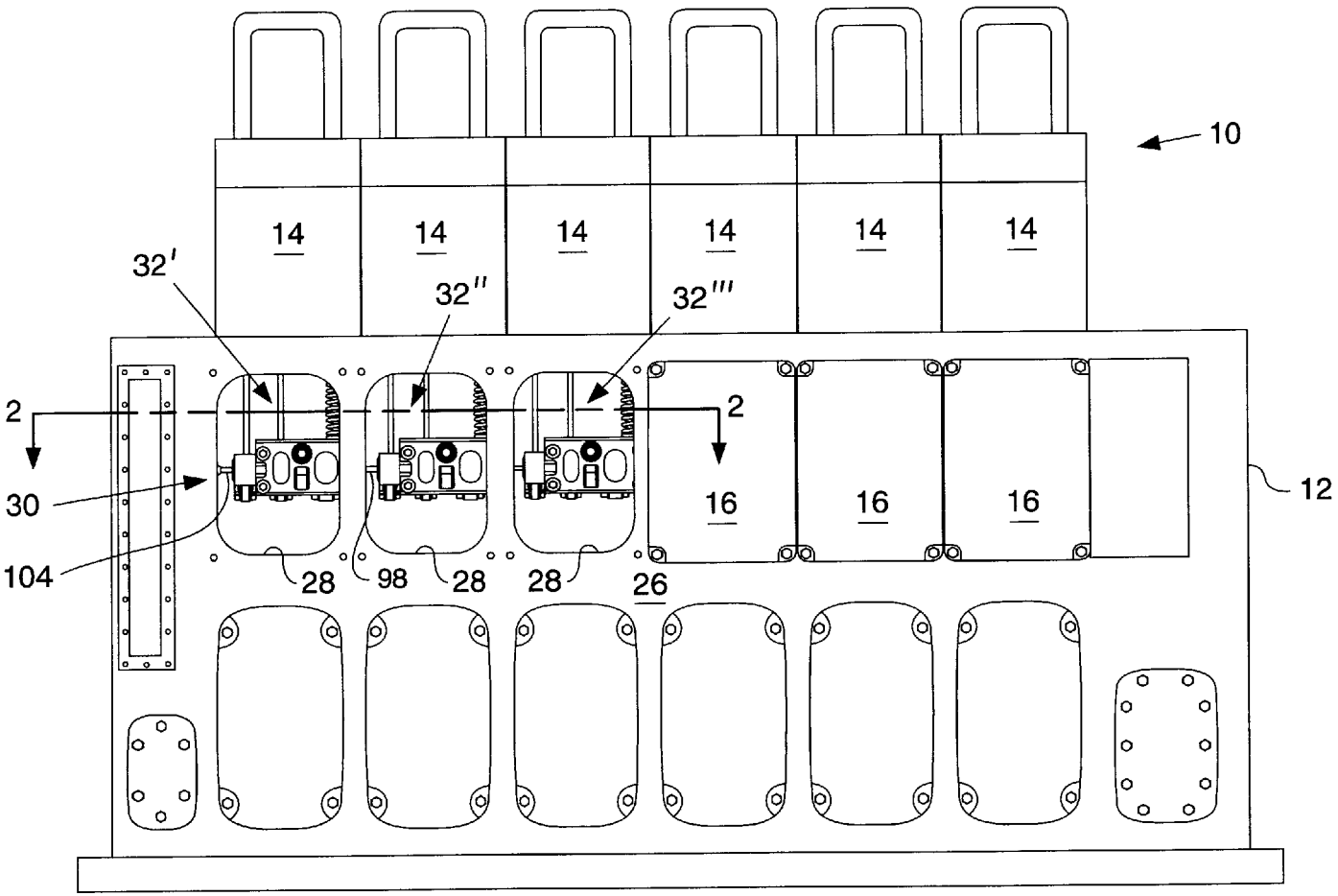
FIG. 1 is a diagrammatic side elevational view of an embodiment of the present invention showing an and internal combustion engine having cylinder heads mounted on an engine block and a plurality of modular camshaft follower assemblies connected to a cam shaft supporting structure of the engine block as each seen through an adjacent access opening in a side wall of the engine block.

With reference to the drawings, an internal combustion engine 10, for example high horsepower gas or diesel engines used in applications such as ships, electric power generation and other industrial applications, having an engine block 12 and a plurality of cylinder heads 14 mounted on the engine block 12 is shown. The cylinder heads 14 each have intake and exhaust valves (not shown) for controlling a flow of intake air to and exhaust gasses from a related combustion chamber (not shown) defined by a piston and cylinder wall (not shown) and the cylinder head 14 in a conventional manner.

A fuel injector pump 18 associated with each combustion chamber is provided for delivering pressurized fuel flow to the combustion chamber. The fuel injector pump 18 is connected to the internal combustion engine 10, such as the cylinder head 14, engine block 12 and camshaft supporting structure 24 at a predetermined location. Actuation of the fuel injector pump 18 causes fuel to be delivered under pressure into the combustion chamber by way of a nozzle (not shown) of any suitable conventional design.

Figure 2:
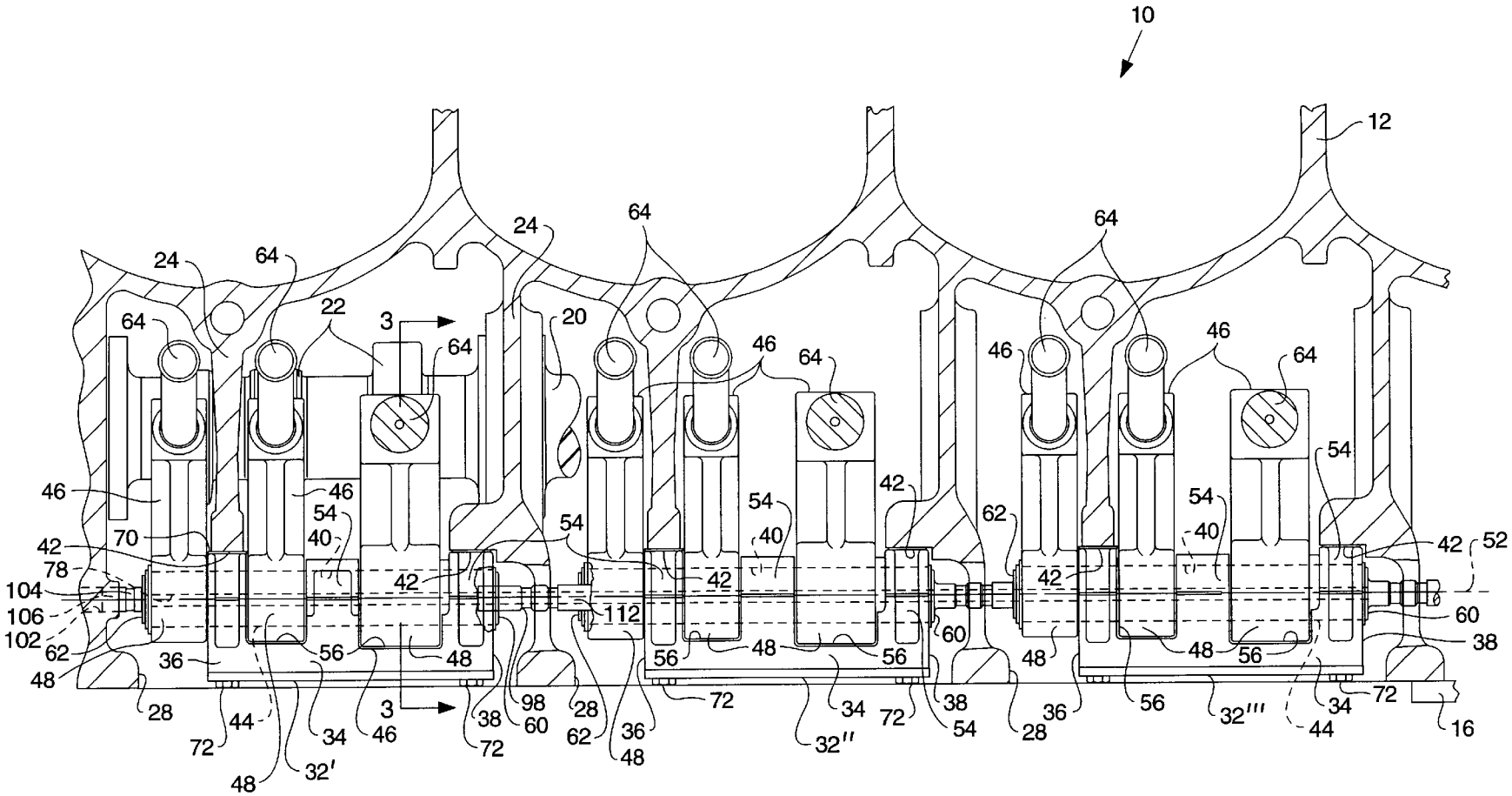
FIG. 2 is a diagrammatic cross section taken along lines 2—2 of FIG. 1.
Figure 3:
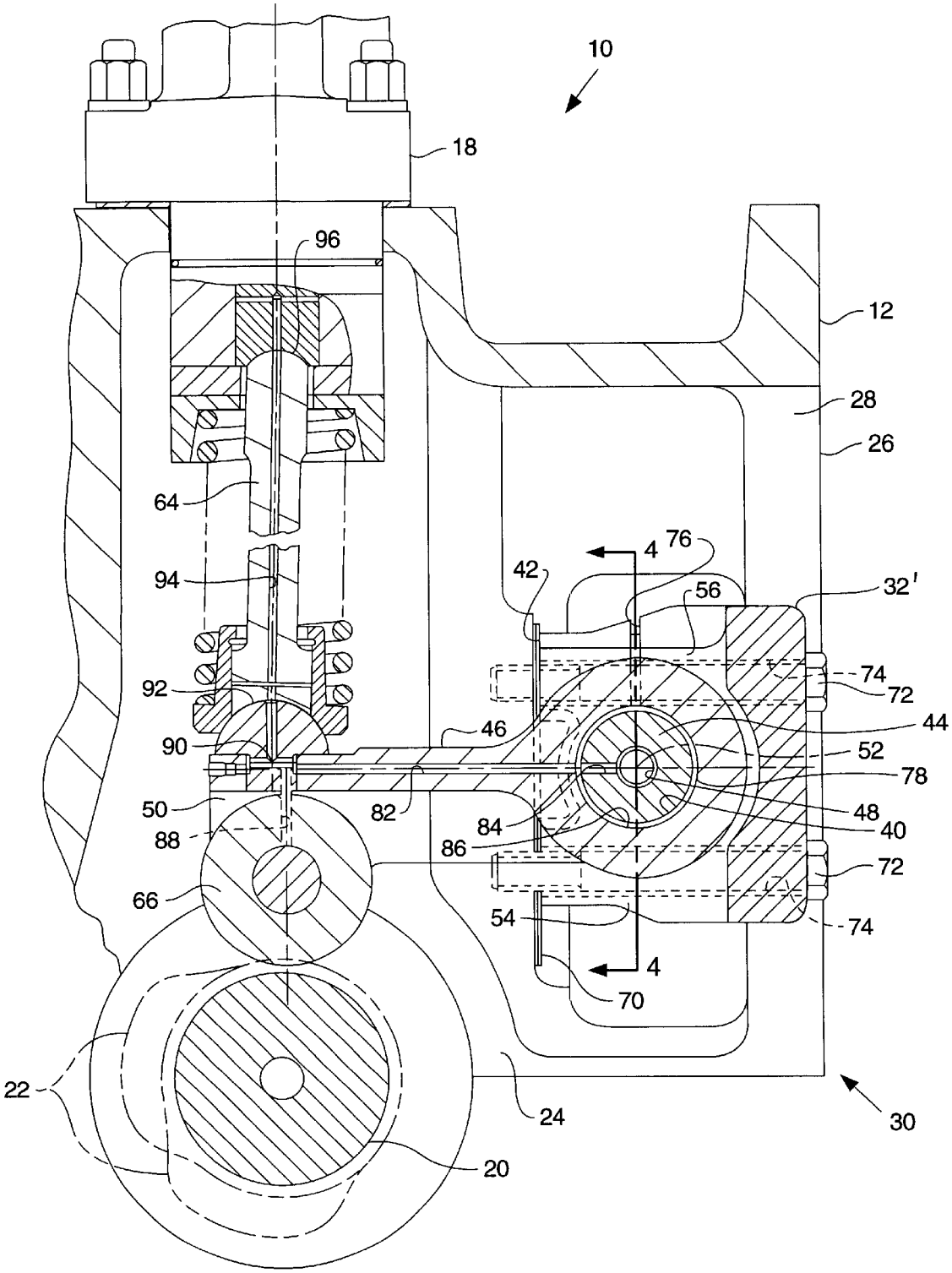
FIG. 3 is a diagrammatic cross section taken along lines 3—3 of FIG. 2.
Figure 4:
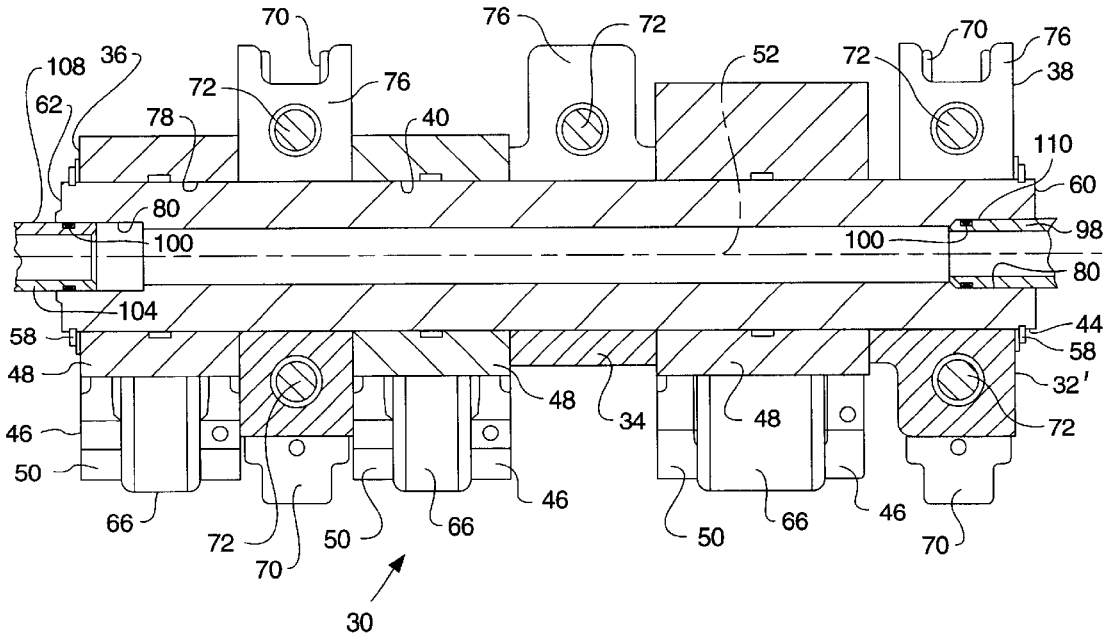
FIG. 4 is a diagrammatic cross section taken along lines 4—4 of FIG. 3.

A camshaft 20 of appropriate conventional design and having a plurality of lobes 22 is mounted for rotation in the camshaft supporting structure 24 in a conventional well known manner. The camshaft supporting structure 24 is connected to the engine block 12. In the embodiment of the invention as shown in FIGS. 2 and 3, the camshaft supporting structure 24 is a portion of the engine block 12 casting.

The engine block 12 has a side wall 26 and a plurality of access openings 28 disposed therein and opening into the engine block 12. Although an access opening 28 of predetermined rectangular dimensions is provided for access in an area adjacent to each cylinder head 14, fewer larger access openings 28 may be provided without departing from the invention. The access openings 28 are of a size sufficient to pass a hereinafter discussed modular camshaft follower assembly 32', 32", 32'" therethrough for installation purposes and to provide access for subsequent adjustment. The access openings 28 are closed by a cover 16 that is removably connected to the engine block 12 in any suitable manner.

A camshaft follower arrangement 30 includes a plurality of substantially identical modular camshaft follower assemblies 32',32",32'", one associated with each combustion chamber. The modular camshaft follower assemblies 32', 32", 32'" provide an interface between the lobes 22 of the camshaft 20 and the intake and exhaust valves and the fuel injector pump 18. Each modular camshaft follower assembly 32',32",32'" has a body 34 having a first and second ends 36,38, a longitudinal bore 40 extending between said first and second ends 36,38 and a side mounting surface 42 located between the first and second ends 36,38. A shaft 44 is disposed in the longitudinal bore 40 of the body 34. A plurality of camshaft following lever arms 46 having first and second spaced end portions 48,50 are connected at the first end portion 48 to the shaft 44 and pivotally movable relative to an axis 52 of the shaft 44. The camshaft following lever arms 46 are maintained at predetermined axially spaced apart locations along the shaft 44 and extending radially from the shaft 44. The camshaft following lever arms 46 are each engageable at the second end portion 50 with the camshaft lobes 22.

The body 34 has a plurality of spaced apart supporting members 54 defining a plurality of spaces 56 between the supporting members 54. Selected camshaft following lever arms 46 are disposed in the spaces 56 and maintained at the predetermined spaced apart locations along the shaft by the supporting members 54. The supporting members 54 provide a stop for the camshaft following lever arms 46 and determine the relative axial positioning of the camshaft following lever arms 46 relative to the camshaft lobes 22 with the body 34 mounted in place on the camshaft supporting structure 24. A lock ring 58 is disposed in a groove at a location adjacent first and second ends 60,62 of the shaft 44. The lock ring 58 prevents inadvertent axial movement of the shaft 44 within the longitudinal bore 40 and acts as an axial movement stop for an end one of said camshaft following lever arms 46 and said shaft 44.

The camshaft following lever arms 46 are biased to follow rotation of the camshaft 20 and pivotally move in response to rotation of the camshaft 20. In particular, each of the camshaft following lever arms 46, engage and follow a respective eccentric camshaft lobe 22 at the second end portion 50 of the camshaft following lever arms 46. The second end portion 50 of the camshaft following lever arms 50 are also engaged with a push rods 64 on a side of the second end portion 50 opposite the camshaft 20. Preferably, a roller 66 is rotatively connected to the second end portion 50 of each of the camshaft following lever arms 46 at a location opposite the push rods 64. The roller 66 is engageable with a camshaft lobe 22 and rolls in response to rotation of the camshaft lobe 22.

The push rods 64 are interconnected between the second end portion 50 of the camshaft following lever arms and the intake valves, exhaust valves and the fuel injection pump 18.

The push rods 64 transfer the lifting force of the camshaft 20 acting on the camshaft following lever arms 46 and movement of the camshaft following lever arms to the intake and exhaust valves and to the fuel injection pump 18.

A shim pack 70 having at least one shim an a predetermined thickness is disposed between the side mounting surface 42 and the camshaft supporting structure 24. The shim pack 70 is provided to adjustably position the body 34 radially relative to the camshaft 20 and the camshaft following lever arms 46 transversely relative to the camshaft 20. This transverse adjustment is important in achieving proper engine timing and most importantly timing of the fuel injector pump 68 actuation.

A plurality of fasteners 72 are provided to releasably connect the body 34 to the camshaft supporting structure 24 at a predetermined location longitudinally relative to the to the camshaft 20. The combination of the shim pack 70 and the fasteners 72 determine the radial position of the body 34 relative to the camshaft 20. Dowel pins (not shown) may be utilized to accurately locate the body 34 relative to the camshaft 20. The fasteners 72 are preferably threaded fasteners 72 which are disposed in clearance holes 74 in the body 34 and screwthreadably connected to the camshaft supporting structure 24. The threaded fasteners 72 also serve to releasably maintain the shim packs between the body 34 and the camshaft supporting structure 24.

The supporting members 54 each have a notch 76 disposed therein which is in a plane substantially parallel to the longitudinal axis 52 of the shaft 44. The notches 76 pass through a portion of the supporting members 54 and open into the longitudinal bore 40 which passes through each of the plurality of supporting members 54. The notches 76 facilitate the clamping of the supporting members 54 to the shaft 44 and maintains the shaft 44 from rotation. Selected ones of the fasteners 72 are disposed in the clearance holes 74 in the supporting members 54 and traverse the notch 76. These fasteners 72 provide the force necessary to deflect the supporting members 54 an amount sufficient to achieve clamping of the supporting members 54 about the shaft 44.

An axially extending aperture 78 is provided in the shaft 44 to deliver fluid flow to the rocker arms (not shown), push rods 64, and the like. The axially extending aperture 78 extends between first and second opposite ends 60,62 of the shaft 44 and is open at the first and second ends 60,62. A counter bore 80, which opens into the axially extending aperture 78, is provided at the first and second ends 60,62 of the shaft 44.

The camshaft following lever arms 46 each have a fluid flow passage 82 in fluid passing communication with the axially extending aperture 78 in the shaft 44. The fluid flow passing passage 82 passes fluid flow between the first and second end portions 48,50 of the camshaft following lever arm 46. In particular, a radially oriented fluid passing passage 84 disposed in the shaft 44 is in fluid passing communication with the axially extending aperture 78 in the shaft 44. An annular grove 86 in either the camshaft following lever arm 46 or in the shaft 44 provides a fluid passing interface between the radially oriented fluid passing passage 84 in the shaft 44 and the fluid flow passing passage 82 in the camshaft following lever arm 46. The fluid flow passing passage 82 in the camshaft following lever arm 46 passes fluid flow from the first end portion 48 of the camshaft following lever arm 46 to the second end portion 50 of the camshaft following lever arm 46. Fluid flow at the second end portion 50 of the camshaft following lever arm 46 is directed by a first fluid flow passing passage 88, intersecting the fluid flow passing passage 82, to lubricate the roller 66. A second fluid flow passing passage 90, intersecting the fluid flow passing passage 82, delivers fluid flow to the push rod 64 to lubricate a first bearing surface 92. The push rod 64 may have a push rod passage 94 which passes fluid flow to additionally lubricate a second bearing surface 96 of the push rod 64.

A first fluid passing conduit 98 is provided to fluidly connect the first end 60 of the shaft 44 of a first modular camshaft following assembly 32' of the plurality of modular camshaft follower assemblies 32', 32", 32'" to the second end 62 of the shaft 44 of a second modular camshaft following assembly 32" of the plurality of modular camshaft follower assemblies 32', 32", 32'" located axially adjacent the first end 60 of the shaft 44 of the first modular camshaft follower assembly 32'. The first fluid passing conduit 98 is adapted to pass lubricating fluid flow between the axially extending apertures 78 of the shafts 44 of the first and second modular camshaft follower assemblies 32', 32". The plurality of fasteners 72 connecting the body 34 of the first and second modular camshaft follower assemblies 32', 32" to the camshaft supporting structure 24 maintains the first fluid passing conduit 98 in connection with the first end 60 of the shaft 44 of the first modular camshaft follower assembly 32' and the second end 62 of the shaft 44 of the second modular camshaft follower assembly 32".

It is to be noted that the substantially identical third modular camshaft follower assembly 32'", as shown, and additional other modular camshaft follower assemblies (not shown) may be provided. Such modular camshaft follower assemblies are serially and sequentially connected, like the first and second modular camshaft follower assemblies 32', 32", in fluid communication with each other and in series with the second modular camshaft follower assembly 32", by a fluid passing conduit of substantially identical construction as that of the first fluid passing conduit 98 and adjustably connected to the camshaft supporting structure 24 in the same manner as the first and second modular camshaft follower assemblies 32', 32".

The plurality of modular camshaft follower assemblies 32', 32", 32'" when at the predetermined adjusted position adjacent a respective cylinder of the internal combustion engine 10 have their shafts 44 substantially axially aligned. This facilitates ease of installation of the modular camshaft follower assemblies 32', 32", 32'".

The first fluid passing conduit 98 is slidably disposed in the axially extending apertures 78 in the shafts 44 of the first and second modular camshaft follower assemblies 32', 32" and passes fluid flow between the axially extending apertures 78. A seal 100, such as an o-ring seal, is disposed between the axially extending apertures 78 in each of the shafts 44 of the first and second modular camshaft follower assemblies 32', 32" and the first fluid passing conduit 98. The seals 100 maintain a substantially leak free connection between the shafts 44 of the first and second modular camshaft follower assemblies 32', 32".

A fluid passing passage 102 provided in the engine block 12 delivers fluid flow from a pump (not shown) to the area adjacent the first modular camshaft follower assembly 32', 32". The fluid passing passage 102 is substantially axially aligned with the axially extending aperture 78 in the shaft 44 of the first modular camshaft follower assembly 32'. A second fluid passing conduit 104 connects the fluid passing passage 102 in the engine block 12 to the second end 62 of the shaft 44 of said first modular camshaft following assembly 32' and passes fluid flow between the fluid passing passage 102 and the axially extending aperture 78 in the shaft 44 of the first modular camshaft following assembly 32'. Preferably, the second fluid passing conduit 104 is slidably disposed in the fluid passing passage 102 in the engine block 12 and slidably disposed in the axially extending aperture 78 in the shaft 44 of said first modular camshaft following assembly 32'. A seal, similar to seal 100, is disposed between the axially extending aperture 78 in the shaft 44 of the first modular camshaft follower assembly 32' and the second fluid passing conduit 104 and between the second fluid passing conduit 104 and the fluid passing passage 102 in the engine block 12.

Like the axially extending apertures 78, the fluid passing passage 102 in the engine block 12 has a counter bore 80 at the location of the seal and the second fluid passing conduit 104. This provides good quality sealing and ease of installation. A plug (not shown) is provided in the axially extending aperture 78 of the shaft 44 of a last one (not shown) of the plurality of modular camshaft follower assemblies at the first end 36 thereof and blocks leakage and facilitates fluid flow to the camshaft following lever arms 46.

INDUSTRIAL APPLICABILITY

With reference to the drawings and in operation the plurality of substantially identical modular camshaft follower assemblies 32', 32", 32'" are each installed through and connected to the camshaft supporting structure 24 of the internal combustion engine 10 with ease and in a simple manner through the access openings 28 disposed in the side wall 26 of the engine block 10.

A first end portion 106 of the second fluid passing conduit 104 is placed in fluid passing communication with the fluid passing passage 102 and a second end portion 108 of the second fluid passing conduit 104 is placed in fluid passing communication with the axially extending aperture 78 at the second end 62 of the shaft 44 of the first modular camshaft follower assembly 32'.

The shim pack 70 is placed between the side mounting surface 42 of the body 34 of the first modular camshaft follower assembly 32' and a camshaft supporting structure 24. The first modular camshaft follower assembly 32' is connected to the camshaft supporting structure 24.

A first end portion 110 of the first fluid passing conduit 98 is placed in fluid passing communication with the axially extending aperture 78 at the first end of the shaft 44 of the first modular camshaft follower assembly 38. A second end portion 112 of the first fluid passing conduit 98 is placed in fluid passing communication with the axially extending aperture 78 opening at the second end 62 of the shaft 44 of the second modular camshaft follower assembly 32".

The shim pack 70 having at least one shim and the predetermined thickness is placed between a side mounting surface 42 of the body 34 of the second modular camshaft follower assembly 32" and the camshaft supporting structure 24. The second modular camshaft follower assembly 32" is connected to the camshaft supporting structure 24.

Once all of the substantially identical modular camshaft follower assemblies 32', 32" and 32'" etc. and the fluid passing conduits 98,104 etc. are installed through the access openings 28 the firing pressure in the first, second and other combustion chambers are measured. A required thickness of the shim packs associated with the first, second and other combustion chambers having a measured firing pressure value greater than and less than a predetermined firing pressure value is then determined. The modular camshaft follower assemblies 32', 32"and 32'" etc. that are within specified tolerances require no adjustment. The thickness of the shim packs 70 of those modular camshaft follower assemblies not within specified tolerances are then adjusted to the required thickness. This adjustment changes the transverse position of the modular camshaft follower assemblies 32', 32", 32'" found to not be within specified tolerances relative to the camshaft and changes the related firing pressure to the predetermined firing pressure.

As indicated the first modular camshaft follower assembly 32'is passed through a first access opening 28 in the side wall 26 which is located adjacent the first combustion chamber and the second modular camshaft follower assembly 32" is passed through a second access opening 28 which is located in the side wall 26 adjacent the second combustion chamber but spaced from the first access opening 28.

The plurality of modular camshaft follower assemblies 32', 32", 32'" being substantially identical in construction facilitates assembly by eliminating careful selection and the reducing the potential for error in choice. Having a common design also reduces the inventory of parts and frees up expensive storage space. Since manufacturing cost is related to volume, the cost of these substantially identical parts are less than having a larger variety.

The fluid passing conduits 98, 104 being slidably sealingly disposed in the axially extending apertures 78 of the shafts at the first and second ends 60,62 and in the fluid flow passing passage 82 simplifies assembly and reduces the potential for leakage as common in threaded conduit connections. The conduits 98, 104 being sandwiched between the first and second ends 60, 62 of the shafts 44 and between the fluid passing passage 102 and the second end 62 of the shaft 44 eliminates the need for special connectors, fittings and the like.

The utilization of shims 70 to adjust the position of the camshaft following lever arms 46 by adjusting the position of the modular camshaft follower assembly 32', 32", 32'" reduces the potential for errors in adjustment by providing a definite location. The shims 70 in combination with the fasteners provides a positive connection and reduces the potential for out of adjustment to occur during operation and over time.

Other aspects and advantages of this invention can be obtained from a study of the drawings the disclosure and the appended claims.

What is claimed is:

1. A camshaft follower arrangement for an internal combustion engine having a camshaft; comprising:

a modular camshaft follower assembly including:

a body having a first and second ends, a longitudinal bore extending between said first and second ends and a side mounting surface located between the first and second ends;

a shaft being disposed in the longitudinal bore of the body;

a plurality of camshaft following lever arms each having first and second spaced end portions, said camshaft following lever arms being connected at the first end portion to the shaft and pivotally movable relative to an axis of said shaft, said camshaft following lever arms being maintained at predetermined axially spaced apart locations along said shaft and extending radially from said shaft, said camshaft following lever arms each being actuatable at said second end portion by the camshaft; and said camshaft follower arrangement including:

a camshaft supporting structure;

a shim pack having at least one shim and being disposed between said side mounting surface and said camshaft supporting structure, said shim pack adjustably positioning said camshaft following lever arms transversely relative to the camshaft; and a plurality of fasteners connecting said body to the camshaft supporting structure at a predetermined location relative to the camshaft.

2. A camshaft follower arrangement, as set forth in claim 1, wherein said body includes a plurality of spaced apart supporting members defining a plurality of spaces therebetween, said camshaft following lever arms being disposed in the spaces and maintained at said predetermined spaced locations along said shaft by said supporting members.

3. A camshaft follower arrangement, as set forth in claim 2, wherein said bore passes through each of said plurality of said supporting members, said supporting members and each have a notch disposed therein and opening into the bore, said notches facilitating a clamping of said supporting members to said shaft.

4. A camshaft follower arrangement, as set forth in claim 3, wherein said fasteners forcibly urging the supporting members into clamping engagement with said shaft and maintaining said shaft from rotation relative to said body.

5. A camshaft follower arrangement, as set forth in claim 1, wherein said second end portion of said camshaft following lever arms being adapted to follow rotating movement of said camshaft and pivotally move in response to rotation of said camshaft, said second end portion of the camshaft following lever arms being engageable with a push rod.

6. A camshaft follower arrangement, as set forth in claim 5, including an axially extending aperture disposed in said shaft and being adapted to receive pressurized fluid flow therein.

7. A camshaft follower arrangement, as set forth in claim 6, wherein said camshaft following lever arms include a fluid passing passage in fluid communication with the push rod and the axially extending aperture disposed in the shaft, said camshaft following lever arms being adapted to pass fluid flow between the axially extending aperture in the shaft and the push rod.

8. A camshaft follower arrangement, as set forth in claim 7, wherein said camshaft following lever arms having a roller rotatively connected to the second end portion of the camshaft following lever arms at a location opposite the push rod, said roller being engageable with the camshaft.

9. A camshaft follower arrangement, as set forth in claim 7, including a fuel injector pump connected to said internal combustion engine, said push rod being located between said camshaft following lever arm and said fuel injector pump and transferring motion therebetween.

10. A camshaft follower arrangement, as set forth in claim 7, wherein said camshaft supporting structure includes a side wall having an access opening disposed therein, said access opening being of a size sufficient to pass the modular camshaft follower assembly through said access opening.

11. A camshaft follower arrangement for an internal combustion engine, comprising:

first and second modular camshaft follower assemblies being of substantially identical construction, said first and second modular camshaft following assemblies each including:

a body having a first and second ends, a longitudinal bore extending between the first and second ends, and a side mounting surface located between the first and second ends;

a shaft having first and second ends and each being disposed in the longitudinal bore of the body, said shaft having an axially extending aperture opening at said first and second ends;

a plurality of camshaft following lever arms each having first and second spaced end portions and being pivotally connected at the first end portion to the shaft, said camshaft following lever arms being maintained at predetermined axially spaced apart locations along said shaft;

said camshaft follower arrangement further including:

a camshaft supporting structure rotatively supporting said camshaft;

a first fluid passing conduit fluidly connecting the first end of the shaft of said first modular camshaft follower assembly to a second end of the shaft of said second modular camshaft follower assembly and passing lubricating fluid flow between the axially extending apertures of the shaft of said first and second modular camshaft follower assemblies; and a plurality of fasteners connecting the body of the first modular camshaft follower assembly to the camshaft supporting structure, the body of the second modular camshaft follower assembly and maintaining the fluid passing conduit in connection with the first end of the shaft of said first modular camshaft follower assembly and the second end of the shaft of said second modular camshaft follower assembly.

12. A camshaft follower arrangement, as set forth in claim 11, wherein said first fluid passing conduit being slidably disposed in said axially extending apertures in the shafts of the first and second modular camshaft following assemblies and passing fluid flow between said axially extending apertures.

13. A camshaft follower arrangement for an internal combustion engine, as set forth in claim 12, including a seal sealingly disposed between the axially extending apertures in the shafts of the first and second modular camshaft following assemblies and the first fluid passing conduit.

14. A camshaft follower arrangement, as set forth in claim 12, including:

an engine block having a fluid passing passage:

a second fluid passing conduit connecting the fluid passing passage to the second end of the shaft of said first modular camshaft following assembly and passing fluid flow between the fluid passing passage and the axially extending aperture in the shaft of said first modular camshaft following assembly.

15. A camshaft follower arrangement, as set forth in claim 13, wherein said second fluid passing conduit being slidably disposed in the fluid passing passage in the engine block and slidably disposed in the axially extending aperture in the shaft of said first modular camshaft following assembly.

16. A camshaft follower arrangement, as set forth in claim 15, including a seal disposed between the axially extending aperture in the shaft of said first modular camshaft following assembly and the second fluid passing conduit.

17. A camshaft follower arrangement, as set forth in claim 12, including a fluid flow passage disposed in each of the camshaft following lever arms and in fluid passing communication with the axially extending apertures in the shafts of the first and second modular camshaft following assemblies, said fluid flow passage in the camshaft following lever arms passing fluid flow between the first and second end portions of the camshaft following lever arms.

18. A camshaft follower arrangement, as set forth in claim 12, including a plurality of shim packs each having at least one shim and being disposed between said side mounting surface and said camshaft supporting structure of each body, said shim packs being adapted to adjustably position each of the plurality of bodies radially relative to the camshaft and transversely position the camshaft following lever arms second end portion at a predetermined position relative to an axis of rotation of the camshaft.

19. A camshaft follower arrangement, as set forth in claim 18, wherein said fasteners being a threaded fastener and said shim packs being releasably maintained between said body and said camshaft supporting structure by said threaded fasteners.

20. A method of adjustably connecting each of a plurality of substantially identical modular camshaft follower assemblies to a camshaft supporting structure of an internal combustion engine, said modular camshaft follower assemblies each having a body, a shaft having first and second ends and an axially extending aperture opening at the first and second ends of said shaft, said shafts each being connected to a respective body, each of said camshaft follower module assemblies having a plurality of spaced apart camshaft following lever arms pivotally connected to the shaft at axially spaced apart locations on the shaft; comprising the steps of:

placing a shim pack having at least one shim and a predetermined thickness between a side mounting surface of a body of a first modular camshaft follower assembly and a camshaft supporting structure;

connecting the first modular camshaft follower assembly to the camshaft supporting structure;

positioning a first fluid passing conduit in fluid passing communication with the axially extending aperture at the first end of the shaft of the first modular camshaft follower assembly;

positioning said first fluid passing conduit in fluid passing communication with an axially extending aperture opening at the second end of a shaft of a second modular camshaft follower assembly of said plurality of camshaft follower module assemblies;

placing a shim pack having at least one shim and a predetermined thickness between a side mounting surface of the body of the second modular camshaft follower assembly and the camshaft supporting structure; and connecting the second modular camshaft follower assembly to the camshaft supporting structure.

21. The method as set forth in claim 20, wherein said internal combustion engine having a combustion chamber associated with the first and second modular camshaft follower assemblies, respectively, and a camshaft; including the steps of:

measuring the firing pressure in the first and second combustion chambers;

determining a required thickness of the shim packs associated with the first and second combustion chambers having a measured firing pressure value greater than and less than a predetermined firing pressure value; and adjusting the thickness of the shim packs to the required thickness and thereby changing a transverse position of the first and second modular camshaft follower assemblies relative to the camshaft and the related firing pressure to the predetermined firing pressure value.

22. The method as set forth in claim 20, including an engine block having a fluid passing passage, and including the steps of:

positioning a second fluid passing conduit in fluid passing communication with the fluid passing passage; and positioning the second fluid passing conduit in fluid passing communication with the axially extending aperture at the second end of the shaft of the first modular camshaft follower assembly.

23. The method as set forth in claim 22, including an engine block having a side wall having a first access opening disposed in the sidewall and at a location adjacent a first combustion chamber, including the step of passing the first modular camshaft follower assembly through the first access opening.

24. The method as set forth in claim 23, including a second access opening disposed in the side wall of the engine block at a location spaced from the first opening and at a location adjacent to the second combustion chamber, including the step of passing the second modular camshaft follower assembly through said second access opening.

* * * * *